United States Patent [19]

Cash

[11] 4,083,138

[45] Apr. 11, 1978

[54] CLOSE COMBAT BACKUP WEAPON

[76] Inventor: Charles Cash, Star Rte., Box 671, Kerrville, Tex. 78028

[21] Appl. No.: 749,760

[22] Filed: Dec. 13, 1976

[51] Int. Cl.[2] ..... F41C 3/00; F42B 11/02

[52] U.S. Cl. ..... 42/1 R; 42/1 G; 102/92.1; 102/92.3

[58] Field of Search ..... 42/1 R, 1 G, 1 H, 1 J; 102/91, 92.2, 92.3

[56] References Cited

U.S. PATENT DOCUMENTS

| | | | |
|---|---|---|---|
| 756,182 | 3/1904 | Novak | 42/1 R |
| 1,073,312 | 9/1913 | Woods | 42/1 J |
| 1,151,320 | 8/1915 | Woods | 42/1 J |
| 2,042,934 | 6/1936 | Gill | 42/1 G |
| 2,844,902 | 7/1958 | Gaylord, Jr. et al. | 42/1 J |
| 3,443,333 | 5/1969 | Manatos | 42/1 G |
| 3,881,421 | 5/1975 | Burczynski | 102/91 |

FOREIGN PATENT DOCUMENTS

| | | | |
|---|---|---|---|
| 327,784 | 7/1909 | France | 42/1 J |
| 492,132 | 2/1930 | Germany | 42/1 J |

*Primary Examiner*—Charles T. Jordan
*Attorney, Agent, or Firm*—Clarence A. O'Brien; Harvey B. Jacobson

[57] ABSTRACT

An elongated tubular barrel is provided having front and rear end portions. The rear end portion of the barrel includes chamber structure for removably chambering a cartridge in the barrel. Firing pin structure for firing a cartridge chambered in the barrel is provided and is shiftable between ready and firing positions. A palm grip is supported from the rear end portion of the barrel of a size to be substantially enclosed within one hand with the forward end of the barrel of the weapon projecting forwardly and outwardly between adjacent fingers of the hand. The forward end of the barrel tapers in wall thickness to a circumferentially unobstructed thin wall portion at the forward terminal end of the barrel, whereby the forward terminal end may be thrust forwardly against a flesh target and at least partially penetrate the target substantially simultaneously with the firing of a cartridge chambered in the barrel.

7 Claims, 6 Drawing Figures

CLOSE COMBAT BACKUP WEAPON

BACKGROUND OF THE INVENTION

Various forms of close combat weapons have been heretofore provided. In addition, small hand held weapons of a size to be substantially entirely enclosed within the hand of a user have also been provided. However, close combat weapons heretofore known and of the firearm class are usually constructed so as to require two hand operation and thus are of a size to prevent the weapon from being substantially fully enclosed within one hand of the user. In addition, some forms of small firearms which may be "palmed" are designed to fire small caliber cartridges only and include firing pin actuating mechanisms which are difficult to manipulate, especially if the user is wearing gloves.

BRIEF DESCRIPTION OF THE INVENTION

The close combat weapon of the instant invention is constructed in a manner so as to be held in the palm of one hand of the user and includes a barrel portion which is adapted to extend between adjacent fingers of the associated hand. The rear end of the weapon includes a palm grip portion which is shiftable in a front to rear direction relative to the barrel of the weapon in a manner such that a sharp forward thrust on the shiftable portion of the palm grip to impact the forward end of the barrel with a target is sufficient to actuate the firing pin mechanism and thereby cause the chambered cartridge to be fired simultaneously with the forward end of the barrel being thrust against the target. In addition, the longitudinal midportion of the barrel includes outwardly projecting and forwardly facing abutment surfaces engageable by the inner surfaces of the fingers of the user whereby a sudden squeezing action on the weapon may also cause the shiftable portion of the palm grip to actuate the firing pin mechanism.

The main object of this invention is to provide a close combat weapon for use by service personnel in close combat circumstances and also usable by law enforcement personnel in similar circumstances in the event their service revolvers have been taken from them during close combat.

Another object of this invention is to provide a close combat weapon designed in a manner whereby it may be readily holstered in an unintrusive manner ready for instant withdrawal from the associated holster and subsequent firing during close combat situations.

Another very important object of this invention is to provide a close combat weapon of a type whose use may be readily and quickly explained.

A still further object of the invention is to provide a close combat weapon in accordance with the preceding objects and constructed in a manner so as to be readily usable in conjunction with conventional ammunition.

A further object of this invention is to provide a close combat weapon which may be readily constructed so as to be marketable at a relatively low cost.

A further important object of this invention is to provide a close combat weapon of the firearm type and including a trigger mechanism which may be readily adjusted to substantially vary the amount of thrust required to fire the weapon.

A final object of this invention to be specifically enumerated herein is to provide a close combat weapon in accordance with the preceding objects and which will conform to conventional forms of manufacture, be of simple construction, and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
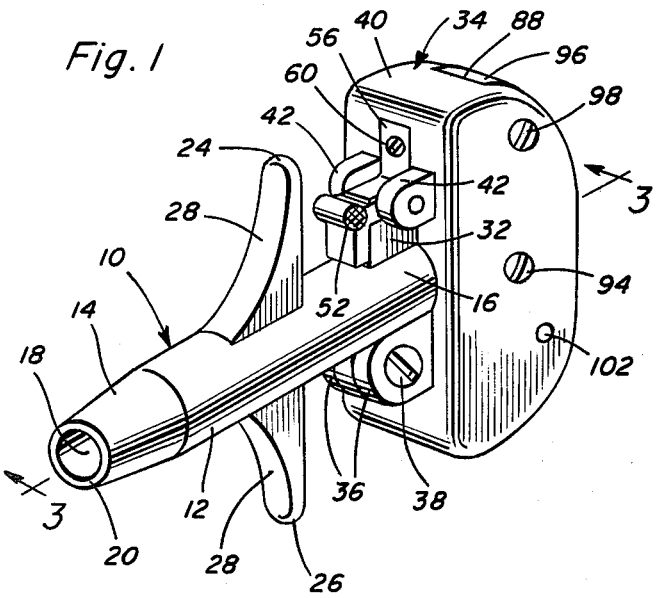
FIG. 1 is a perspective view of the close combat weapon of the instant invention.

Referring now more specifically to the drawings, the numeral 10 generally designates the close combat weapon of the instant invention. The weapon 10 includes an elongated tubular barrel 12 having front and rear end portions 14 and 16. The barrel 12 has a longitudinal bore 18 formed therethrough and the forward end portion of the barrel 12 tapers externally toward the forward terminal end 20 thereof as at 22. The wall thickness of the forward terminal end 20 of the barrel 12 is approximately 1/16 of an inch.

The barrel 12 includes oppositely, outwardly directed abutments 24 and 26 centrally intermediate its opposite ends and the abutments 24 and 26 include forwardly facing radiused surfaces 28.

The rear end portion 16 of the barrel 12 includes a central downwardly projecting mounting lug 30 and an upwardly projecting and fowardly facing abutment lug 32. In addition, a palm grip assembly referred to in general by the reference numeral 34 is supported from the rear end portion 16 of the barrel 12. The assembly 34 includes a pair of lower forwardly projecting and laterally spaced mounting lugs 36 between which the lug 30 is received and a pivot fastener 38 is passed and secured through the lugs 30 and 36 and thereby serves to pivotally attach the palm grip assembly 34 to the rear end portion 16 of the barrel 12 for oscillation of the palm grip assembly 34 between the solid and phantom line positions thereof illustrated in FIG. 3.

The palm grip assembly 34 includes a main body portion 40 from which the lugs 36 are supported and the upper portion of the front side of the body 40 includes a second pair of forwardly projecting and laterally spaced lugs 42. The lugs 42 are provided with aligned transverse bores formed therethrough as are the lugs 36 and an L-shaped latch 44 has one leg 46 thereof pivotally anchored between the lugs 42 by means of a pivot pin 48 passed through the lugs 42 and the leg 46. The second leg 50 of the latch 44 projects downwardly in front of the abutment lug 32 and the outer corner of the L-shaped latch 44 includes a transverse finger grip 52.

A first leg 54 of an L-shaped spring 56 overlies and is abutted against the upper surface of the leg 46 of the latch 44. A second leg 58 of the spring 56 is secured to the front face of the body 40 by means of a fastener 60 and the spring 56 therefore serves to yieldingly bias the latch 44 to the latched position thereof illustrated in FIG. 3 of the drawings with the palm grip assembly 34 retained in the solid line position of FIG. 3.

Figure 3:
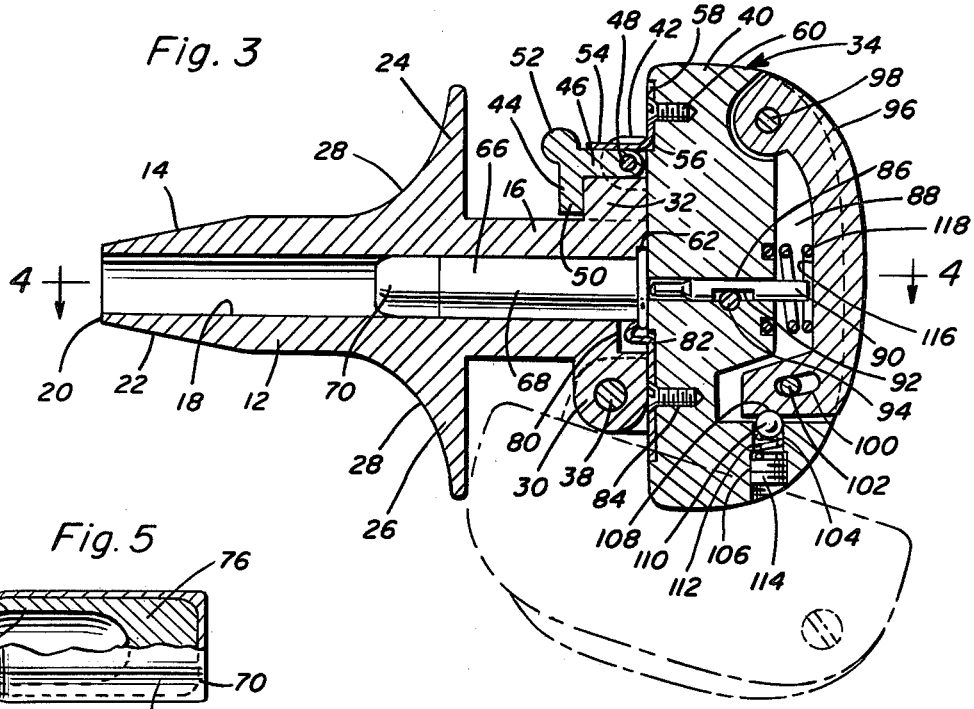
FIG. 3 is an enlarged, longitudinal, vertical sectional view taken substantially upon the plane indicated by the section line 3—3 of FIG. 1.
Figure 5:
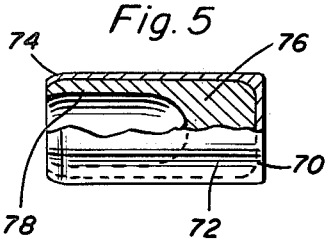
FIG. 5 is a side elevational view of a first form of projectile which may be utilized in conjunction with the weapon, portions of the projectile being broken away and illustrated in longitudinal section.
Figure 4:
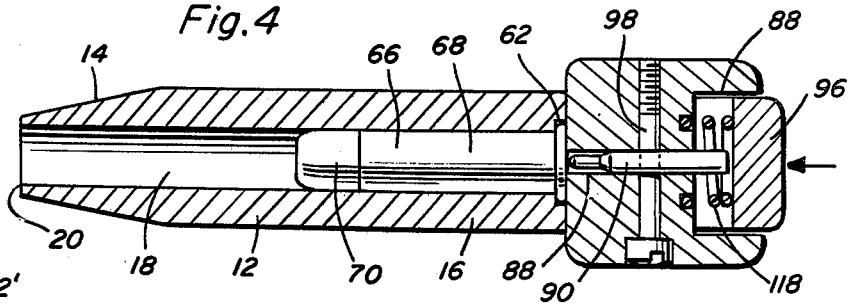
FIG. 4 is a horizontal sectional view taken substantially upon the plane indicated by the section line 4—4 of FIG. 3.

The rear end of the bore 18 includes a diametrially enlarged counterbore 62 and it may be seen from FIG. 3 that a 38 caliber cartridge 66 may be removably chambered in the rear end of the bore 18. The cartridge 66 includes the usual 38 caliber shell 68, but does not include a conventional bullet. Rather, the shell 68 is provided with a modified form of bullet or projectile 70 such as that illustrated in FIG. 5 of the drawings. The bullet 70 includes a forwardly opening cylindrical and cup-shaped jacket 72 whose forward end is open and slightly inwardly curved as at 74. The interior of the jacket 70 includes a lead or other dense material interior lining 76 and the lead lining 76 is provided with a forwardly opening recess 78 therein. The jacket 72 is constructed of conventional material, such as steel, brass, or copper.

The rear end portion 16 of the barrel 12 is relieved as at 80 and a shell ejecting spring-type strap 82 is attached to the lower portion of the forward face of the body 40 by means of a fastener 84 and projects into the relieved area 80 for engagement with the shell 68 in order to eject the same from the rear end of the barrel 12 when the palm grip assembly 34 is swung from the solid line position thereof illustrated in FIG. 3 to the phantom line position of FIG. 3.

The center of the body 40 includes a front to rear extending bore 86 formed therethrough whose forward end coincides with the longitudinal center axis of the bore 18 and whose rear end opens into a rearwardly opening recess 88 formed in the body 40. An elongated cylindrical firing pin 90 is slidingly disposed in the bore 86 and is notched as at 92. A transverse retaining pin 94 is secured through the body and passes through the notch 92 in order to limit front and rear shifting of the pin 90 in the bore 86.

A firing pin actuator portion 96 is provided in the recess 88 and includes an upper end portion pivotally mounted in the recess 88 by means of a pivot pin 98 secured through the portion 96 and having its opposite ends supported from the body 40. The lower end of the portion 96 includes a short arcuate slot 100 whose center of curvature coincides with the center axis of the pivot pin 98 and a transverse pin 102 is secured through the lower portion of the body 40 is received through the slot 100 and thereby limits front to rear shifting of the lower end of the portion 96. Still further, the lower end of the body 40 is provided with an upstanding bore 104 opening into the lower end of the recess 88 and including a diametrically enlarged threaded lower end portion 106. The lower side of the portion 96 includes a downwardly opening semi-cylindrical recess 108 and the upper end of the bore 104 has a ball detent 110 mounted therein seatable in the recess 108 and biased upwardly in the bore 104 by means of a compression spring 112 adjustably secured in the diametrically enlarged lower end portion 106 of the bore 104 by means of a threaded abutment 114.

The outer or rear end of the firing pin 90 closely opposes the forward face 116 of the vertical central area of the portion 96 and a compression spring 118 is interposed between the forward face 116 and the opposing rearwardly facing portion of the body 40. Thus, the spring 118 yieldingly biases the portion 96 to its rearmost position with the ball detent 110 seated in the recess 108 and the ball detent 110 retains the portion 96 against forward swinging movement until a forward thrust of approximately ten pounds is applied to the rear face of the portion 96, the amount of thrust required to shift the portion 96 forwardly being adjustable through the adjustment of the abutment 114.

Figure 6:
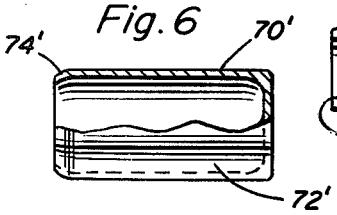
FIG. 6 is a side elevational view similar to FIG. 5 illustrating a second form of projectile or bullet, portions of the second form of bullet also being broken away and illustrated in longitudinal, vertical section.

With attention now invited more specifically to FIG. 6 of the drawings, there will be seen a modified form of bullet referred to by the reference numeral 70' and which is substantially identical to the bullets 70 in that it includes a jacket 72' corresponding to the jacket 72 with the forward end of the jacket 72' being open and slightly forwardly tapered as at 74'. However, the bullet 70' does not include a lining such as the lining 76.

In operation, when it is desired to chamber a cartridge such as the cartridge 66 in the barrel 12, the catch or latch 46 is swung upwardly from the position thereof illustrated in FIG. 3 in order to swing the leg 50 above the abutment lug 32 and the palm grip assembly 34 may then be swung from the solid line position of FIG. 3 to the phantom line position of FIG. 3 exposing the rear end of the bore 18 of the barrel 12. At this point, the cartridge 66 may be chambered in the rear end of the bore 18 and the palm grip assembly 34 may be swung back to the closed position thereof illustrated in phantom line in position in FIG. 3 with the latch 44 then being released to retain the palm grip assembly 34 in the closed position. The weapon 10 may then be holstered in a holster designed specifically therefor in a manner such that immediate access to the weapon 10 may be had and it will be noted that the weapon 10 may be initially gripped in a convenient manner ready for instant firing.

Figure 2:
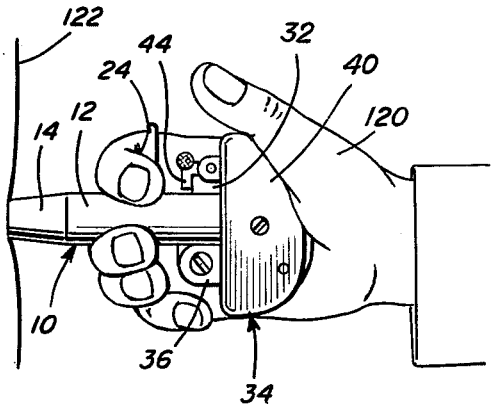
FIG. 2 is a side elevational view illustrating the manner in which the weapon may be held in one hand in close combat and with the forward end of the barrel of the weapon abutted against a target immediately prior to firing of the weapon.

After the weapon 10 has been withdrawn from its holster (not shown), it is gripped in the user's hand 120 in the manner illustrated in FIG. 2 of the drawings with the forward end portion 14 of the barrel 12 projecting between the first and second fingers of the hand 120 and the palm grip assembly 34 substantially enclosed within the palm of the hand 120. Thereafter, with the first finger of the hand 120 disposed forwardly of the abutment 24 and engaged with the corresponding radiused surface 28 and the second and third fingers engaged with the radiused surface 28 of the abutment 26, the weapon may be squeezed in order to force the portion 46 forward. However, the ball detent 110 retains the lower portion of the portion 96 in a rearmost position until sufficient forward pressure is applied to the portion 96, at which time the ball detent 110 will be unseated from the recess 108 and the lower portion of the portion 96 will move sharply forward in a snap action in order to cause the firing pin 90 to abut with the rear end of the cartridge 68 with sufficient force to cause the cartridge to be fired.

However, if the weapon 10 is held in the hand 120 as illustrated in FIG. 2 and the user's arm supporting the hand 120 is thrust sharply forwardly in order to abut the forward terminal end 20 of the barrel 12 against a flesh target 122, the thin wall portions 20 at the forward extremity of the barrel 12 may at least partially penetrate the target 122 and the forward thrust of the weapon 10 against the target 122 will cause the firing pin 90 to discharge the weapon 10. Accordingly, at substantially the same time the weapon 10 is thrust forwardly against the target 122, the cartridge 66 may be fired and not only will either the bullet 70 or the bullet 70' be propelled into the target 122, but the expanding propelling gases within the bore 18 behind the bullet 70 or 70' will be discharged directly into the wound formed by the bullet fired. Therefore, the weapon 10 has tremendous shock impact when used in close combat.

The bullet 70 is substantially heavier than the bullet 70', but the forward end of the bullet 70 is also open thereby enabling the bullet 70 to spread and tear through the flesh of the target 122 after entering the latter. Further, the bullet 70', while not being as heavy as the bullet 70, is also open on its forward end and is, therefore, also capable of spreading and tearing through the flesh of the target 122.

The palm grip assembly 34 is approximately one inch in transverse width and two inches in height whereby it may be readily fully "palmed". Further, the abutments 24 and 26 are spaced forwardly of the rear of the palm grip assembly 34 a distance to allow the inner surfaces of the first, second and third fingers of the hand 120 to comfortably grip the abutments 24 and 26 and the length of the barrel forward of the abutments 24 and 26 is at least sufficient to position the forward terminal end 20 at least one inch forward of the fingers, whereby the forward terminal end 20 may be thrust into a flesh target.

Still further a flexible, chamois, holster of a size to snugly receive the weapon 10 therein and including a finger stall-like projecting portion may be used to support the weapon from a central forward waist portion of the user of the weapon with the latter totally hidden from view within the holster and the latter anchored to the user's belt or other clothing part by a single (or multiple) snap structure for instant use of the weapon. In such case, the weapon, within the flexible holster, may be quickly grasped and pulled from its belt supported position and fired in the above described manner while still in the holster. Also, due to the small size of the weapon, it may be received in a specially made glove worn by the user and including an extra short finger stall between the first and second finger stalls of the glove fore receiving the barrel of the weapon therein. In this manner, the weapon is maintained in a substantially hidden position ready for instant use.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A close combat weapon comprising a tubular barrel having front and rear end portions, the rear end portion of said barrel including chamber means for removably chambering a cartridge in said barrel, firing pin means for firing a cartridge chambered in said barrel and shiftable between ready and firing positions, a palm grip supported from the rear end portion of said barrel and of a size to be substantially enclosed within one hand of a user of said weapon with the forward end of said barrel projecting forwardly and outwardly between adjacent fingers of said hand, the forward end of said barrel tapering in wall thickness to a circumferentially unobstructed thin wall portion at the forward terminal end of said barrel, whereby said forward terminal end may be thrust forwardly against a flesh target and at least partially penetrate said target substantially simultaneously with the firing of said cartridge, said palm grip including a rearwardly facing shiftable portion thereof supported for limited front to rear shifting relative to said barrel between forward and rearward positions, said shiftable portion being operatively associated with said firing pin means to effect movement of the latter from said ready position to said firing position in response to shifting of said shiftable portion from said rear position to said forward position, said palm grip including a main body having a rearwardly facing rear surface, said shiftable portion being shiftably supported from said body and projecting rearwardly of said rear surface, detent means connected between said shiftable portion and said main body yieldably resisting forward movement of said shiftable portion, whereby a forward thrust on said shiftable portion relative to said main body above a predetermined value will effect sudden forward snap action movement action of said shiftable portion relative to said body to the forward position thereof and thus effect snap action movement of said firing means pin from said ready position to said firing position.

2. A close combat weapon comprising a tubular barrel having front and rear end portions, the rear end portion of said barrel including chamber means for removably chambering a cartridge in said barrel, firing pin means for firing a cartridge chambered in said barrel and shiftable between ready and firing positions, a palm grip supported from the rear end portion of said barrel and of a size to be substantially enclosed within one hand of a user of said weapon with the forward end of said barrel projecting forwardly and outwardly between adjacent fingers of said hand, said palm grip including at least a portion thereof supported for limited front to rear shifting relative to said barrel and yieldingly biased toward its rearmost position, said palm grip portion being operatively associated with said firing pin means for shifting the latter from the ready position to the firing position in response to forward shifting of said palm grip portion from its rearmost position toward its forwardmost position, said palm grip including a main body having a rearwardly facing rear surface, said shiftable portion being shiftably supported from said body and projecting rearwardly of said rear surface, detent means connected between said shiftable portion and said main body yieldably resisting forward movement of said shiftable portion, from said rearmost position whereby a forward thrust on said shiftable portion relative to said main body above a predetermined value will effect sudden forward snap action movement of said shiftable portion relative to said body to said forward position thereof and thus effect snap action movement of said firing pin means from said ready position to said firing position.

3. The combination of claim 2, wherein said main body is pivotally supported from the rear end portion of said barrel for swinging into and out of closed position closing the rear end of said barrel, said main body portion and said barrel including coacting latch means operative to releasably retain said main body portion in said closed position.

4. The combination of claim 2, wherein said cartridge includes a forwardly opening shell casing and a bullet mounted in the open forward end of said shell casing.

5. The combination of claim 4, wherein said bullet includes a hollow forwardly opening cup-shaped jacket.

6. The combination of claim 5, wherein said jacket includes at least a thin interior lining of dense material.

7. The combination of claim 5, wherein said jacket is devoid of any interior structure inward of the interior surfaces of said jacket.

* * * * *